United States Patent [19]

Kimes

[11] Patent Number: 4,964,179

[45] Date of Patent: Oct. 23, 1990

[54] TOILET SEAT FOR DISABLED PERSONS

[76] Inventor: Robert H. Kimes, Hickory Hill Box 33, Freeport, Ill. 60132

[21] Appl. No.: 407,109

[22] Filed: Sep. 14, 1989

[51] Int. Cl.[5] ..... A47K 13/00

[52] U.S. Cl. ..... 4/239; 4/237

[58] Field of Search ..... 4/234, 235, 237, 239; 297/250, 253

[56] References Cited

U.S. PATENT DOCUMENTS

| | | | |
|---|---|---|---|
| 1,194,392 | 8/1916 | Judd | 4/237 |
| 2,736,053 | 3/1956 | Lang | 4/239 |
| 2,804,630 | 9/1957 | Gould | 4/239 |
| 2,810,914 | 10/1957 | Hamilton | 4/239 |
| 3,209,376 | 10/1965 | Drury, Jr. | 4/239 |
| 4,214,323 | 7/1980 | Thomas | 4/239 |
| 4,477,932 | 10/1984 | Lenosky | 4/237 |

FOREIGN PATENT DOCUMENTS

| | | | |
|---|---|---|---|
| 1312522 | 11/1962 | France | 4/239 |

*Primary Examiner*—Henry J. Recla
*Assistant Examiner*—Kath Kupferschmid
*Attorney, Agent, or Firm*—McCaleb, Lucas & Brugman

[57] ABSTRACT

A toilet seat assembly for the disabled, particularly those who are wheelchair bound with spinal chord injuries. The seat is fitted to a conventional toilet and is fixed or removably mounted in elevated position above the rim of the toilet bowl to provide lateral openings or clearance for the insertion of the user's hand to carry out perineal cleaning functions. The height of the raised seat is such as to promote easy user transfer from a wheelchair. A bracket for attaching the seat to the toilet bowl is supportive of arm supports for assisting the user on and off the seat.

4 Claims, 2 Drawing Sheets

TOILET SEAT FOR DISABLED PERSONS

This invention relates generally to sanitation equipment and more specifically to improved toilet seats for use by disabled humans, particularly the wheelchair bound.

BACKGROUND OF THE INVENTION

Existing and known toilet facilities for the disabled are generally unsatisfactory in that they do not accommodate perineal cleaning by the disabled user, especially those having spinal chord injuries which seriously limits or prevents leg use so that they are unable to raise up from the seat to carry out those functions. In U. S. application, Ser. No. 07/333,687, filed Apr. 5, 1989, now U.S. Pat No. 4,882,791 the inventor hereof disclosed an improved toilet for disabled persons having similar provision for perineal cleaning by the disabled user. However, despite the marked improvements of the invention disclosed in said application, there remains need for means to adapt the conventional toilet to the requirements of the disabled and it is to that aspect of the art that the present invention is directed.

BRIEF SUMMARY OF THE INVENTION

The improved toilet seat structure of this invention comprises an elevated seat attachable, either in fixed, semi-permanent or removable fashion, to a conventional toilet such that the seat thereof is elevated above the upper rim of the toilet bowl and suitably supported thereover to provide lateral openings or spaces capable of receiving the user's hand, wrist and forearm for perineal cleaning purposes. The height of the seat is at a level which is substantially co-planar with the seat of a normal wheelchair to promote easy transfer of a disabled user between the wheelchair and the toilet seat. Bracket means are provided for connecting the seat assembly with the toilet and such preferably includes supporting means capable of receiving and holding conventional arm supports or the like for assisting the user onto and off of the seat. The seat of this invention importantly is not hingedly mounted as a conventional toilet seat is, but instead is stationarily secured over the toilet bowl by a bracket assembly, one part of which is fastened to the toilet and the other to the toilet seat. The two parts are slidably interjoined by means of a socket chamber into which a protruding portion of the seat joined part is insertable. Provision is made to secure the two assembly parts together either for semi-permanent installation or for quick detachment of the seat as desired. Support means are provided beneath the leading and trailing ends of the toilet seat per se to support the same in parallel elevated position over the upper rim of the toilet bowl. This provides the user with perineum access.

It is an important object of this invention to provide an improved toilet seat structure for use by disabled persons, particularly those who are wheelchair bound, which afford the user perineum access without the necessity of raising from the toilet seat.

It is another important object of this invention to provide an improved toilet seat structure for the disabled, which is constructed and arranged to promote easy transfer of the disabled person between the toilet seat and a wheelchair.

Still another important object of this invention is to provide an improved toilet seat structure for the disabled which is attachable to a conventional toilet and thereby converts the same for use by a disabled person who is unable to raise from the toilet seat to effect perineal cleaning.

Having described this invention, the above and further objects, features and advantages thereof will be recognized by those skilled in the art from the following detailed description of a preferred embodiment thereof illustrated in the accompanying drawings and representing the best mode presently contemplated for enabling those of skill in the art to practice the same.

IN THE DRAWINGS

FIG. 1 is an exploded perspective view illustrating the detached bracket and seat assemblies of the toilet seat structure according to this invention; and FIG. 2 is a side elevational view of a conventional toilet assembled with the improved toilet seat of this invention; and FIG. 3 is a partial perspective view of a modified seat structure.

DESCRIPTION OF THE PREFERRED EMBODIMENT

Figure 1:
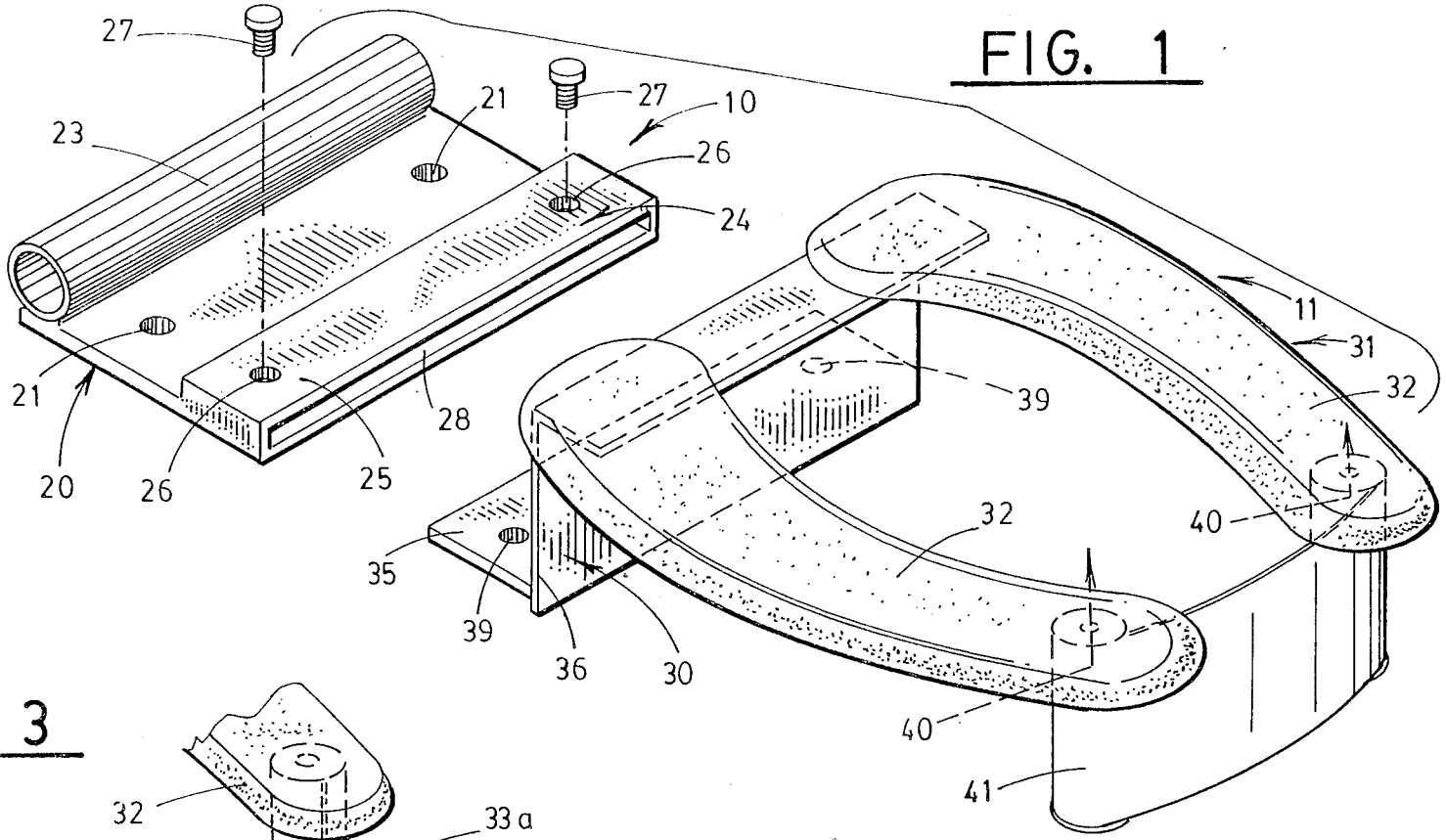

With particular reference to the drawings, the perspective view of FIG. 1 demonstrates the features of an improved elevated toilet seat structure for use by the disabled according to this invention.

Figure 2:
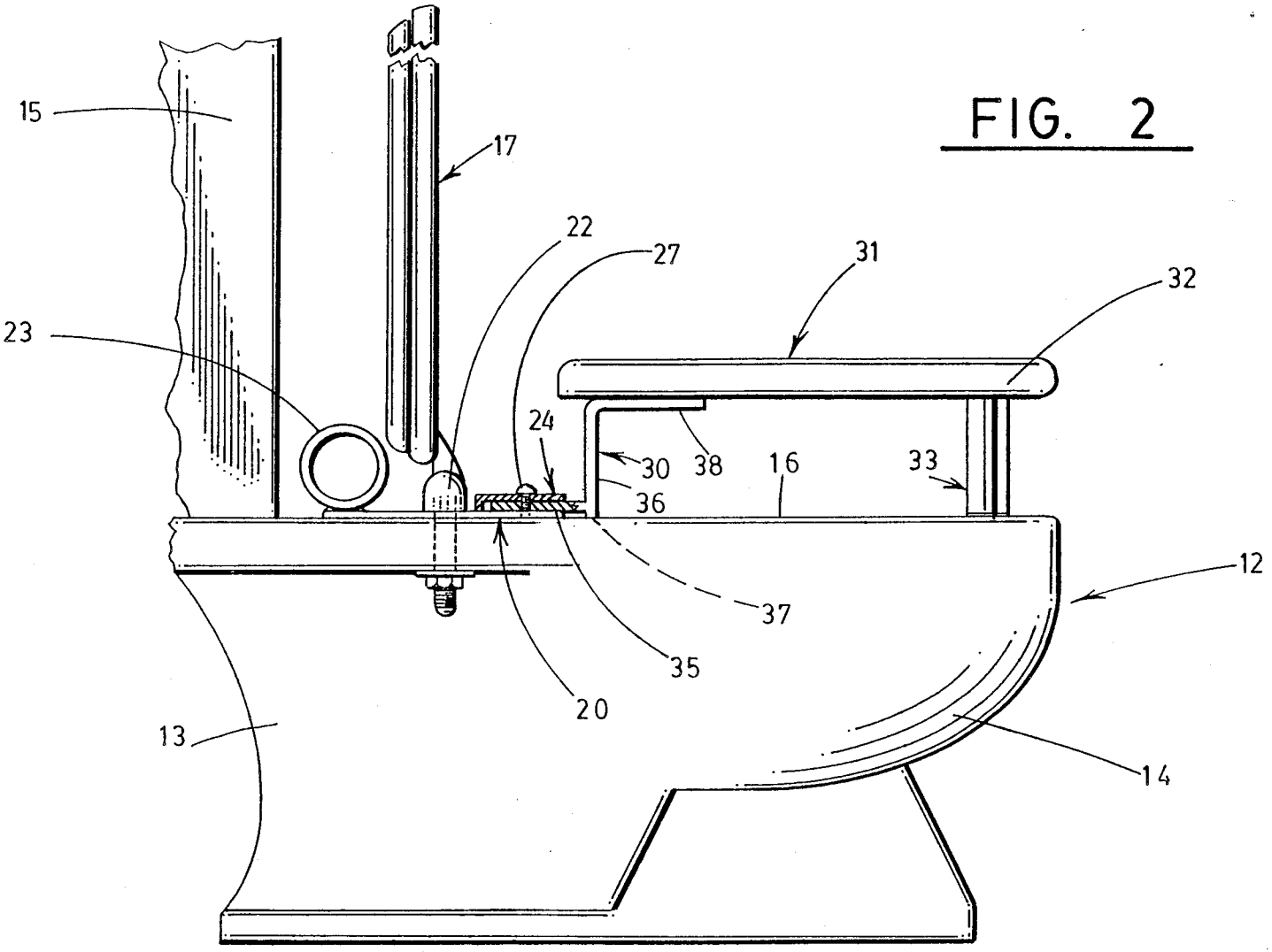

As there shown, the improved seat structure comprises a mounting bracket assembly 10 and a seat assembly 11 which are adapted to be interlocked and mounted on a conventional ceramic toilet assembly, indicated generally at 12 in FIG. 2 of the drawings. Typically, toilet assembly 12 comprises a floor engaging base/-pedestal portion 13 supporting an integral water receptive toilet bowl 14 and a water closet 15, the latter being mounted on the upper rear of the base pedestal in conventional fashion.

In other instances closet 15 may be formed integrally with the base pedestal of assembly 12 or may comprise a cantilever wall mounted style toilet (not illustrated herein) of known features to which the present invention is adapted with equal facility.

In the usual standard floor mounted toilet assembly as illustrated in FIG. 2, the upper rim 16 of bowl 14 is located approximately 15" from the supporting base or floor. In accordance with this invention the elevated seat assembly 11 is arranged so that the upper face of the user supporting seat lies in a plane substantially 19–20" above floor level for the purposes of accommodating ready transition between a typical wheelchair and the seat assembly 11 while affording lateral entry beneath the seat for perineal cleaning purposes, as will appear in greater detail from descriptive materials which follow. It also will be noted that the usual toilet seat 17 remains on the toilet in raised position when seat assembly 11 is in operating position (see FIG. 2).

With reference to FIGS. 1 and 2 of the drawings, the particulars of the mounting bracket assembly 10 are apparent as comprising a planar, generally rectangular mounting plate 20 having two openings or holes 21 therethrough which are in laterally spaced positions for reception of the normal mounting bolts 22 associated with the hingedly mounted seat 17 of toilet assembly 12. Thus plate 20 is secured to the upper face of the toilet base rearwardly of the bowl 14, permitting normal hinged movement and use of seat 17 when seat assembly 11 is removed. Plate 20 is further distinguished by a tubular mounting member 23 extending across the rearward edge thereof; such member being receptive of arm supports (not shown) of conventional and known structure capable of being floor mounted on opposite sides of the toilet assembly to assist the user.

At the opposite or leading edge of the plate 20 from the tubular mounting member 23 is a box-like structure 24 open along one elongated side thereof lying opposingly adjacent the seat assembly 11. Otherwise structure 24 may be generally closed about it's periphery and fixed to the upper face of plate 20, as by welding, to provide an enclosing upper wall 25 spaced (approximately ⅛–¼ of an inch) from the upper face of mounting plate 20. Wall 25 is distinguished by a pair of through openings 26, 26 receptive of threaded fastener bolts 27 adapted to engage aligned threaded openings (not shown) formed through the mounting plate 20. This structure provides connective means comprising a chamber socket 28 between the wall 25 and the base mounting plate 20 for reception of cooperating means of a seat attachment bracket 30 associated with seat assembly 11, as will appear presently.

Figure 3:
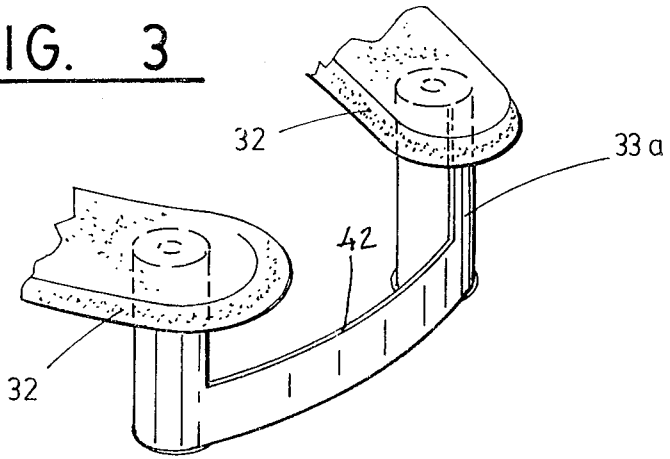

Seat assembly 11 comprises the above mentioned seat attachment bracket 30, a padded toilet seat assembly 31, shown herein as comprising a pair of identical, actuate shaped seat sectors 32, 32 of the so called split seat formation and a rigid seat support 33 or a modified support **33*a* of FIG. 3 disposed at the forward or leading ends of the two seat sectors 32**. The seat sectors are symmetrically disposed on opposite sides of the toilet bowl.

Attachment bracket 30, as best shown in FIG. 2 of the drawings is generally Z-shaped in end elevation, having connector means formed as an operationally horizontal planar tongue portion 35, insertable into socket chamber 28 of the bracket assembly 10. Portion 35 is integral with and disposed at right angles to a vertical elevating leg portion 36 which extends below the plane of tongue portion 35. Thus the lower end 37 of leg 36 is engageable with the upper rim 16 of the toilet bowl in operation. An upper horizontal seat attachment platform 38, attachable to the two seat sectors 32, 32 as by holding screws, (not shown) extends at right angles to the upper end of leg portion 36 and in an opposite direction from tongue portion 35. As previously noted, the tongue portion 35 of bracket 30 is insertable into the socket chamber 28 of bracket assembly 10 and is provided with a pair of openings 39 (see FIG. 1) that are laterally spaced and aligned with the openings 26, 26 for reception of the mounting bolts 27 when tongue portion 35 is fully inserted into chamber 28. In this respect it is contemplated that seat assembly 11 may be semi-permanently attached to bracket assembly 10 or removably secured thereto. In the event permanent mounting is desired, it is proposed that mounting bolts 27 best constitute special headed fasteners such as recessed socket type machine screws which are not easily removable without special tools. In the event that temporary or removable mounting is desired, bolts 27 may constitute large wing or knurled headed bolts so that the seat assembly may be conveniently detached by hand from bracket assembly 10 and removed from the toilet, permitting conventional use of the hinged toilet seat 17.

Attachment bracket 30, as well as the mounting bracket assembly 10 preferably are made of stainless steel or some other non-corrosive material resistive of the operating atmosphere in which the present invention is utilized.

As noted heretofore seat sectors 32, 32 are secured to the planar platform portion 38 of the attachment bracket 30. The seat sectors, if that style of toilet seat is employed as opposed to closed or a horseshoe shaped seat, for example, preferably are of padded construction for comfort to the user. In order to maintain the seat sectors in a desired elevated position above the rim of the toilet bowl, forward support of the sectors 32 is required. For that purpose a rigid support bracket 33 is employed to cooperate with support leg 36 of bracket 30.

As shown in FIGS. 1 and 2 of the drawings, the support bracket 33 constitutes a stainless steel or, if desired, plastic or other rigid inert material member, of semi-arcuate form and sufficient lateral width to bridge between and beneath the seat sectors 32, 32 to which it is attached, as by attachment bolts or screws extending through tab portions 40 formed at the upper ends of tubular end formations 41 thereof. Bracket 33 is of sufficient vertical dimension to locate the outer end of the seat assembly 31 at a desired horizontal level above the rim of the toilet bowl. It also serves to maintain the forward ends of the seat sectors 32, 32 fixed in laterally spaced positions. The lower end of support 33 rests freely on the rim of the toilet bowl a shown.

In FIG. 3 a modified bracket **33*a* is shown which is similar in structure and purpose to bracket 33 except that the main body thereof is cut away to provide an opening 42** for insertion of the user's hand, wrist and forearm if that approach to the perineum is elected.

From the foregoing it is believed that those familiar with the art will readily recognize its novel aspects and appreciate what while this invention is herein disclosed in relation to a specific preferred embodiment, the same is nevertheless open to modification and substitution of equivalents without departing from the spirit and scope of this invention as defined in the following appended claims.

The embodiments of the invention in which an exclusive property or privilege is claimed are defined as follows:

1. For use with a conventional toilet having a base supporting a water receptive toilet bowl bordered by an upper rim, a toilet seat structure for converting the toilet to use by a disabled person, comprising:

a seat assembly comprising a stationary toilet seat, a unitary elevating support attached to a forward end of said seat and extending vertically therebeneath to a downward facing surface which rests freely on top of the upper rim of the toilet bowl and is the sole support for said forward end;

a substantially z-shaped attachment bracket connected to a rearward end of said toilet seat comprising a leg extending vertically downwardly from the underside of said seat and having a lower end thereof adapted to rest atop said rim including connector means projecting horizontally from said leg adjacent said lower end thereof;

said leg and elevating support cooperating to support and maintain said toilet seat in horizontal position elevated over said rim of said bowl;

a mounting assembly comprising a planar plate adapted to be attached to the base of the toilet rearwardly adjacent said bowl, and connective means fixed to said plate including means opposing said attachment bracket for inserted reception of said connector means whereby to anchor said seat assembly in stationary position on the toilet;

the elevation of said seat above said rim providing an open spacing therebetween of sufficient size and extent to permit the entry of the hand, wrist and forearm as necessary to effect perineal cleaning without raising from said seat.

2. The seat structure of claim 1, wherein said connective means of said mounting comprises:

an elongated chamber having an open side, said connector means of said seat assembly comprises a planar tongue portion insertable into said chamber, and means for locking said tongue portion in said chamber whereby to anchor said seat assembly to said toilet.

3. The toilet seat structure of claim 1 wherein said mounting assembly is comprised of said planar plate having openings receptive of the mounting bolts associated with a conventional hinged toilet seat attached to the toilet, and mounting means at one end of said plate remotely of the toilet bowl for connection with arm supports for assisting the user onto and off of said toilet seat.

4. The toilet seat structure of claim 1, wherein said elevating support is joined to said forward end of said seat and is formed with an opening of sufficient extent to permit insertion of the hand, wrist and forearm as necessary for perineal cleaning.

* * * * *

UNITED STATES PATENT AND TRADEMARK OFFICE

CERTIFICATE OF CORRECTION

PATENT NO. : 4,964,179

DATED : October 23, 1990

INVENTOR(S) : Robert H. Kimes

It is certified that error appears in the above-identified patent and that said Letters Patent is hereby corrected as shown below:

Col. 5, line 11, after mounting insert -- assembly --.

Signed and Sealed this

Seventeenth Day of March, 1992

*Attest:*

HARRY F. MANBECK, JR.

*Attesting Officer*

*Commissioner of Patents and Trademarks*